US006592121B2

(12) United States Patent
Frank et al.

(10) Patent No.: US 6,592,121 B2
(45) Date of Patent: Jul. 15, 2003

(54) APPARATUS FOR SYNCHRONIZING TRANSFERS OF SHEET MATERIAL

(75) Inventors: Hendrik Frank, Heidelberg (DE); Thomas Schaeffer, Mauer (DE); Martin Greive, Schönau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 21 days.

(21) Appl. No.: 09/998,988

(22) Filed: Nov. 30, 2001

(65) Prior Publication Data

US 2002/0063382 A1 May 30, 2002

(30) Foreign Application Priority Data

Nov. 30, 2000 (DE) ..... 100 59 592

(51) Int. Cl.[7] ..... B65H 5/02

(52) U.S. Cl. ..... 271/270; 271/3.21; 271/264; 271/275

(58) Field of Search ..... 271/3.21, 3.18, 271/264, 270, 275; 198/341.1, 341, 792; 399/371, 396; 358/488

(56) References Cited

U.S. PATENT DOCUMENTS 5,193,458 A 3/1993 Keller
5,481,971 A * 1/1996 Grutzmacher et al. ..... 101/183
5,924,362 A * 7/1999 Volz et al. ..... 101/183
5,927,195 A * 7/1999 Volz et al. ..... 101/183
5,947,023 A * 9/1999 Bohrer et al. ..... 101/181
5,988,063 A * 11/1999 Brandenburg et al. ..... 101/219
6,095,043 A * 8/2000 Hartmann et al. ..... 101/183

FOREIGN PATENT DOCUMENTS

| | | |
|---|---|---|
| DE | 19 30 317 B2 | 1/1970 |
| DE | 25 01 963 | 12/1975 |
| DE | 195 11 682 A1 | 10/1996 |
| EP | 0 561 474 A1 | 9/1993 |
| GB | 2 314 834 A | 1/1998 |
| WO | WO 98/53996 | 12/1998 |

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

An apparatus for transporting a sheet material through a sheet-processing machine is described. The transport system for the sheet material has a drive that is driven independently of the cylinders on the stations processing the sheet material in the sheet-processing machine. The transport system provides at least synchronization of a transport device conveying the sheet material and of the cylinders.

20 Claims, 14 Drawing Sheets

APPARATUS FOR SYNCHRONIZING TRANSFERS OF SHEET MATERIAL

BACKGROUND OF THE INVENTION

Field of the Invention

The invention relates to an apparatus for synchronizing transfers of a sheet material, such as sheets of paper or board to be printed during their transport through sheet-processing machines such as rotary printing machines.

Published, Non-Prosecuted German Patent Application DT 25 01 963 A1 relates to a gripper carriage drive. In a printing machine having a feeder and a deliverer unit, the sheet to be printed is preferably guided on horizontal paths in the grip of a gripper. The gripper carriages in each case carrying the individual sheets function as armatures with the printing-unit and return running rails which are disposed on both sides in the side walls of the printing machine, form an endless belt and function as stators. Together with the printing-unit and return running rail functioning as stators, the gripper carriages each form a linear motor connected to a control device. This solution constitutes the coupling of machine groups to linear drives that are guided on a closed circular path.

During the conveyance of articles, such as sheets to be printed, through the printing units of multicolor rotary printing machines, the articles are transferred from one transport system to the following transport system at the interfaces between the transport systems used there. In the case of rotary printing machines, the sheet material is transferred from one cylinder to the next by the gripper systems of the two cylinders holding the sheet simultaneously for a brief moment. The preceding system is then opened and the sheet material is still held only by the following system. The transfer necessitates mechanical components inter-engaging. The mechanical coupling of the cylinders via the gear train ensures the accurate-register transfer of the sheet material and the collision-free dipping action of gripper bars in one another.

However, if the drives of the cylinders of printing units in rotary printing machines are configured as individual drives, so that there is no longer any mechanical coupling of the cylinders to the gear train, in the event of a failure of a drive, caused by faults in the electronic control and motor, it is no longer ensured that the gripper bars gripping the sheet material will dip into one another without collision. The same problem arises when linear units are used for the sheet transport, and the sheet material is held and conveyed by gripper bars that are driven on one or both sides by linear motors. The sheet material is then transferred by the linearly moved gripper bar to the respective next cylinder. If components of the individual drive fail here, it is also necessary to ensure that gripper bars and cylinders do not collide with one another. Published, Non-Prosecuted German Patent Application DT 25 01 963 A1, mentioned at the beginning, discloses a machine concept in which linearly driven gripper bars transport paper sheets through a rotary printing machine with printing units disposed one behind another. In this solution, machine groups—gripper carriages here—are coupled by linear drives that are guided on a closed circular path.

The configuration does not have any mechanical collision safeguard to prevent the gripper bars being drawn into the printing units. Transfer units based on linear motors, which implement the transfer of the sheet material or the transfer of sheet material from and to printing-unit cylinders, have hitherto been configured without any collision safeguard. This results in an availability deficit in the event of faults, since the remaining components of the rotary printing machine are in this case not protected against collision of mechanical parts.

One previously known possible solution to the technical problem indicated is to synchronize the gripper bars that are fastened to chains with the cylinders. This is achieved by gripper bars fixed to chains being fixed by prismatic elements between impression cylinder and blanket cylinder.

SUMMARY OF THE INVENTION

It is accordingly an object of the invention to provide an apparatus for synchronizing transfers of sheet material which overcomes the above-mentioned disadvantages of the prior art devices of this general type, which ensures the collision-free entry of linearly driven holding devices conveying the sheet material, and also the collision-free passage of the holding devices, along the press nip and to prevent damage to cylinders processing the sheet material.

With the foregoing and other objects in view there is provided, in accordance with the invention, an apparatus for transporting a sheet material in a sheet-processing machine having individual stations with cylinders. The apparatus contains a transport system for the sheet material having drives driven independently of the cylinders of the individual stations processing the sheet material in the sheet-processing machine; and at least one cylinder-coupled collision safeguard functioning as a synchronization mechanization bringing about a synchronization of the transport system conveying the sheet material and the cylinders.

By the solution proposed according to the invention, both the maintenance of the register accuracy and the avoidance of collisions may be implemented by various elements. While the maintenance of register is substantially achieved by the use of mutually synchronized electronically controlled drives, the mechanical elements which are proposed in accordance with the invention and are mechanically coupled to the cylinders accommodated, for example, in the printing unit of a rotary printing machine, ensure protection against collision of moving machine parts. According to the solution proposed in accordance with the invention, the coupler drives monitoring a small movement area with regard to the collision are assisted by mechanical safety elements which can be retracted, so that the collision-free entry of the gripper bars conveying the sheet material into the printing area is ensured in the case of advanced or retarded gripper bars (during disrupted operation).

With the solution proposed in accordance with the invention, it is further possible, in the case of linearly driven gripper bars which are merely used to transfer the sheet between the printing unit and the deliverer, to ensure collision-free operation, in particular prevent damage to the expensive and complicatedly produced cylinders, in the event of failures.

In order to rule out the situation where the complicatedly and expensively produced cylinders in the printing unit of a rotary printing machine are damaged in the event of fault by the asynchronous entry of units conveying the sheet material, it is ensured that the elements preventing the collision in the printing unit of a rotary printing machine are coupled precisely to the cylinders to be protected.

In a development of the idea according to the invention, as a collision safeguard in printing units of rotary printing machines, synchronization mechanisms are used whose output movement is coupled to the position of a transverse cylinder and/or a cylinder carrying the sheet material. The cylinders substantially to be protected against collision with gripper bars in the printing unit are the blanket cylinder that transfers the ink to the surface of the sheet material and also the paper-carrying impression cylinder supporting the sheet material in the printing unit of a rotary printing machine. If, in the event of turner devices being used in rotary printing machines, anti-smear coatings are applied to the impression cylinder, the protection of its surface finished in such a way is all the more important.

According to a further aspect of the solution proposed in accordance with the invention, an output element of the synchronization mechanism functioning as a collision safeguard is driven at a higher speed as compared with the tangential speed of the linear element conveying the sheet material. In this way, before the gripper element gripping the sheet material dips into the press nip with the tangential speed, it is possible to achieve the situation where the output element carries out a catching-up movement, so that it is ensured that linear units, that is to say gripper bars driven by linear units, which arrive "retarded" are drawn positively through the channel of the cylinder.

According to the invention, it is further proposed to construct the synchronization mechanism as a flexible drive mechanism, whose circulating flexible drive drives an operating element on the respective cylinder with a speed profile which overtakes or catches up as compared with the rotating cylinder. By the solution, it is possible to ensure that, in the event of a fault, linear units gripping the sheet material and arriving retarded can be set into a collision-preventing position in relation to the rotating cylinders in the printing unit of a rotary printing machine.

The synchronization mechanisms proposed in accordance with the invention contains transmission elements of which one is accommodated on a pivot mounted offset in relation to the axis of rotation of the corresponding cylinder. In order to offset the pivot, it may be expedient, using a centrally mounted crank rocker, to use two inter-meshing gearwheels. Advantageously fixed to the output pinion of the pair of gearwheels is the crank that introduces the rotational movement into a coupler that, in turn, represents the output element. Using this configuration, an output drive movement is obtained which produces a catching-up movement shortly before the critical point occurs for avoiding a collision between the cylinder circumference, that is to say its outer surface, and the gripper bar which fixes the sheet material and is arriving retarded as the result of a fault.

By the coupler mechanisms functioning as the synchronization mechanisms in the printing unit of a rotary printing machine in order to avoid collisions between the cylinders and the linear units conveying the sheet material, it is possible to ensure the freedom from collision only within a small area, as a result of the configuration. Therefore, in a development of the idea on which the invention is based, it is proposed to use flexible drive mechanisms which circulate in a form-fitting manner with the cylinders of a printing unit of a rotary printing machine and are driven synchronously. The flexible drive mechanisms preferably circulate at the tangential speed of the cylinders of the printing unit of a rotary printing machine.

Advantageously introduced into the flexible drive mechanisms are openings prepared as slots which constitute dip-in areas for safety elements which are accommodated on the carriages of the linearly driven gripper bars which, in turn, convey the sheet material through the rotary printing machine. The length of the individual openings configured as slots in the flexible drive mechanism determines the area in which the carriage of the relevant linear unit can be positioned. If a carriage of a linear unit retarded because of a fault misses the opening area of the slot, the spring-loaded bolt functioning as a safety device is not able to engage in the slot and travels with one of its ends against a catching edge provided on the frame. The carriage of the gripper bars driven by linear drives are provided with bolt-like safety elements which, for the purpose of gradual braking, are provided with a stop surface which, when they run onto a brake chamfer or when they enter a continuously tapering gap, can effect gradual braking of the carriages of the linear units, so that no abruptly occurring shocks are introduced into the rotary printing machine.

Instead of safeguarding the cylinders by the position of the carriages of the linear units in relation to the circulating flexible drive mechanisms, the synchronization mechanisms functioning as coupler mechanisms may also be associated with cam-controlled catching devices, which enable or prevent the passage of a carriage of a relevant linear unit having a gripper bar in the linear guides. The catching devices contain a cam disk, which has mutually different radial areas including transition areas, whose setting against the bolt-like catching fingers effects their insertion and retraction movement into the linear guides guiding the carriages of the linear units.

In a development of the idea on which the invention is based, catching disks functioning as stops can be provided at the ends of the cylinders of a printing unit of a rotary printing machine, and are provided on the circumference with recesses, which are aligned with the respective channels in the cylinders of the sheet-processing machine. This prevents gripper bars being drawn into the printing units in the event of a collision, that is to say in the event of the presence of a fault in the linear drive of the gripper bars. By use of the stop surfaces of the catching disks, poorly synchronized or unsynchronized gripper bars may be intercepted. The synchronization grooves of the catching disks are made around the channels of the cylinders of the printing unit and are dimensioned such that the linear drives are able to position the gripper bars fixed to them exactly in the press nip. If the drives miss the groove, they are braked by the catching disks in such a way that destruction of the expensively and complicatedly produced cylinders in the printing unit of a rotary printing machine can definitely be prevented.

In a further variant of the solution proposed in accordance with the invention, a stop finger that can be controlled by a cam disk is disposed on a cylinder, the cam disk being driven directly by the rotation of the cylinder to be protected against damage arising from collisions, and the cam disk connecting on a catching element which can be moved vertically. In addition, it is likewise conceivable to dispose segments on the ends of the cylinder cams to be protected against collision, the segments extending stop fingers directly into the conveying path for the gripper bars conveying the sheet material through the rotating system.

The solution proposed in accordance with the invention may be used both in rotary printing machines with and without a turner device; in addition, in multicolor rotary printing machines, which can both be equipped with and without a turner device turning the sheet material. In addition, possible uses of the apparatus proposed in accordance with the invention are provided in sheet-processing machines that operate in accordance with the digital printing process. Further possible uses for the apparatus proposed in accordance with the invention for preventing collisions between moving machine components are to be seen in further-processing units such as stack-forming binding devices and the like.

Other features which are considered as characteristic for the invention are set forth in the appended claims.

Although the invention is illustrated and described herein as embodied in an apparatus for synchronizing transfers of sheet material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
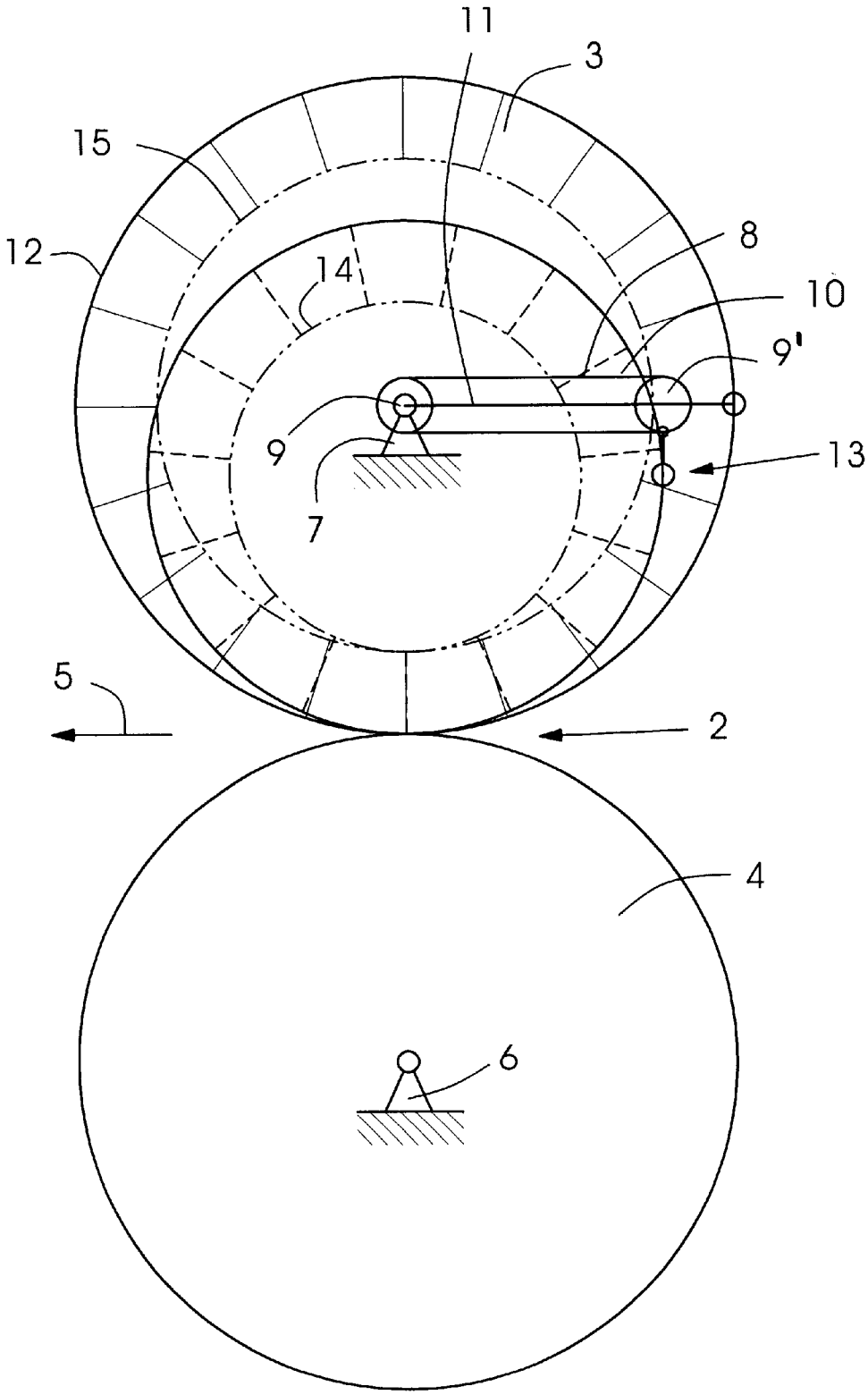
FIG. 1 is a diagrammatic, illustration of a synchronization mechanism with a double crank and a flexible drive mechanism containing an operating point according to the invention.

Referring now to the figures of the drawing in detail and first, particularly, to FIG. 1 thereof, there is shown an illustration that reveals in more detail a synchronization mechanism which contains a flexible drive mechanism which, for example, can be configured as a belt or toothed-belt drive.

The illustration according to FIG. 1 reveals two cylinders 3 and 4 that cooperate with each other and form a press nip 2. Reference symbol 3 identifies a transfer cylinder provided on its outer surface 12 with a cover, while reference symbol 4 designates the impression cylinder cooperating with the former and bounding the press nip 2. The transfer cylinder 3 rotates about a fixed bearing 7, while the impression cylinder 4 rotates about an axis of rotation accommodated in fixed bearings 6. Accommodated coaxially with the axis of rotation of the transfer cylinder 3 is a stationary or suitably moved belt pulley 9, which cooperates with a belt pulley 9' accommodated further out in the radial direction on the transfer cylinder 3. Around the two aforementioned belt pulleys 9, 9' there runs a flexible drive 10 constructed as a toothed belt or as a flat belt, and in addition, a crank element 11 is rotatably accommodated concentrically with the axis about which the cylinder 3 rotates. An operating element 13 in the form of a gripper or the like which can be operated is let into the outer surface 12 of the transfer cylinder 3.

By non-illustrated gripper bars, a sheet material 75 is conveyed in the direction of movement 5 through the press nip 2 bounded by the outer surfaces of the two cylinders 3, 4 cooperating with each other and, during the passage through the press nip 2, is printed on one side by the ink-carrying cover accommodated on the outer surface 12 of the transfer cylinder 3, and, during the printing operation, is supported by the outer surface of the impression cylinder 4 located underneath.

By using the configuration revealed by FIG. 1, it is achieved that the operating element 13 at some points executes an overtaking movement relative to the circulating transfer cylinder 3. The overtaking movement can be used for the purpose of drawing gripper bars that arrive retarded into a collision-free position relative to the transfer cylinder 3. Reference symbol 15 designates the constant speed variation of the outer surface of the transfer cylinder 3, while the train of curves designated by reference symbol 14 identifies the different speeds of the operating element 13 during one complete revolution of the transfer cylinder 3.

Figure 2:
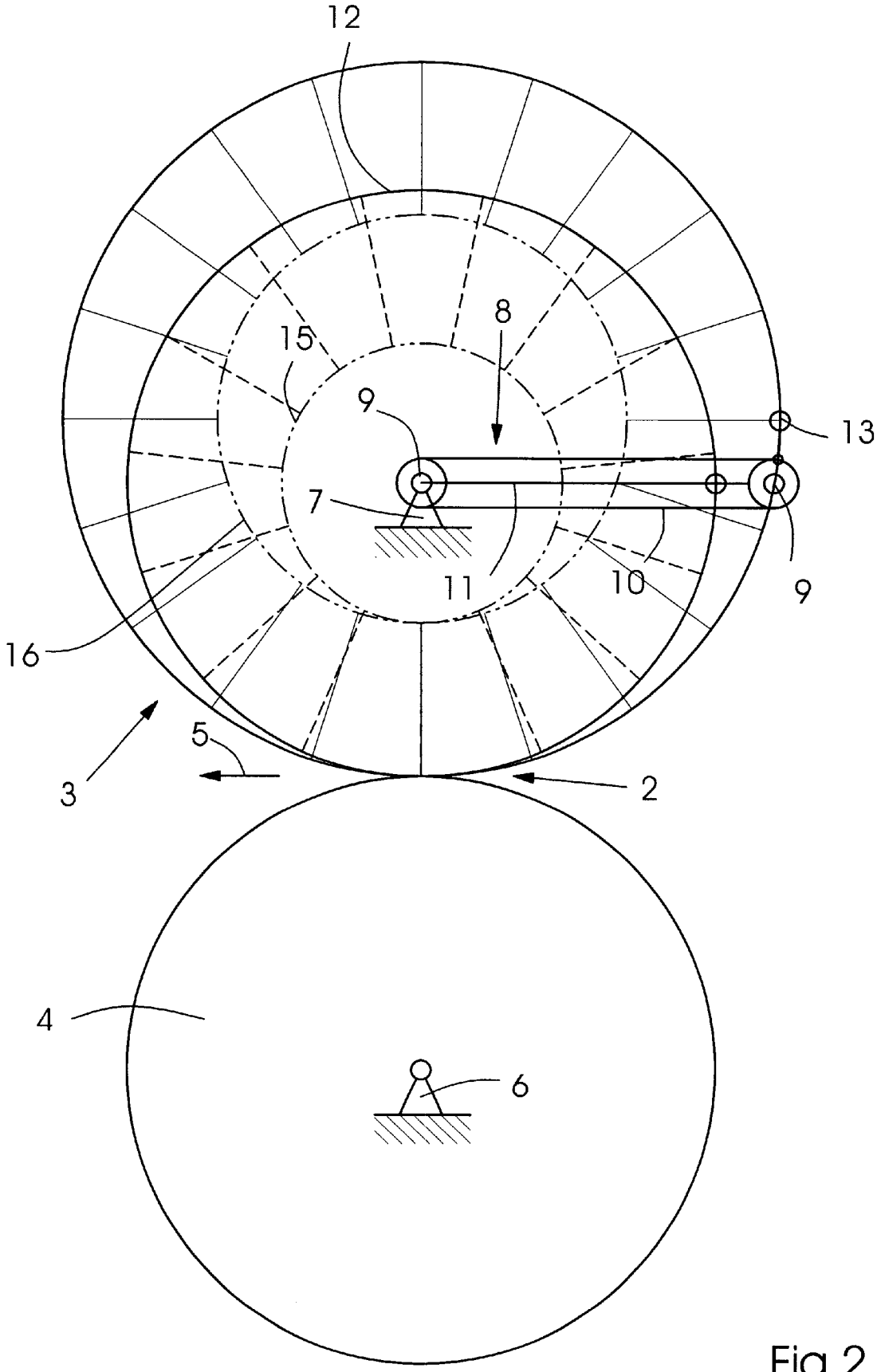
FIG. 2 is an illustration of a variant of the synchronization mechanism with a symmetrical speed profile of the operating element.

The illustration according to FIG. 2 reveals in more detail a configuration variant having a speed variation of the operating element 13 that is different from FIG. 1.

According to the configuration, too, the two mutually cooperating cylinders 3 and 4 form the press nip 2, through which the sheet material is conveyed in the direction of movement 5 and, in the process, is printed on one side. The mutually cooperating cylinders 3 and 4 are rotatably accommodated in the fixed bearings 6 and 7 in the side walls of a printing unit of a rotary printing machine. The transfer cylinder 3 illustrated at the top is permanently associated with the crank element 11, which is disposed centrally in relation to a flexible drive mechanism 8. In a way similar to the illustration of FIG. 1, the deflection element 9 is accommodated in the fixed bearing 7 of the transfer cylinder 3, around which deflection element the flexible drive 10 circulates and operates the operating element 13 on the circumference surface of the transfer cylinder 3. A comparison of the speed variations 15 of the outer surface 12 of the cylinder and a speed variation 16 of the operating element 13 reveals that a symmetrical overtaking speed of the operating element 13 in relation to the outer surface 12 of the transfer cylinder 3 is established.

Figure 3A:
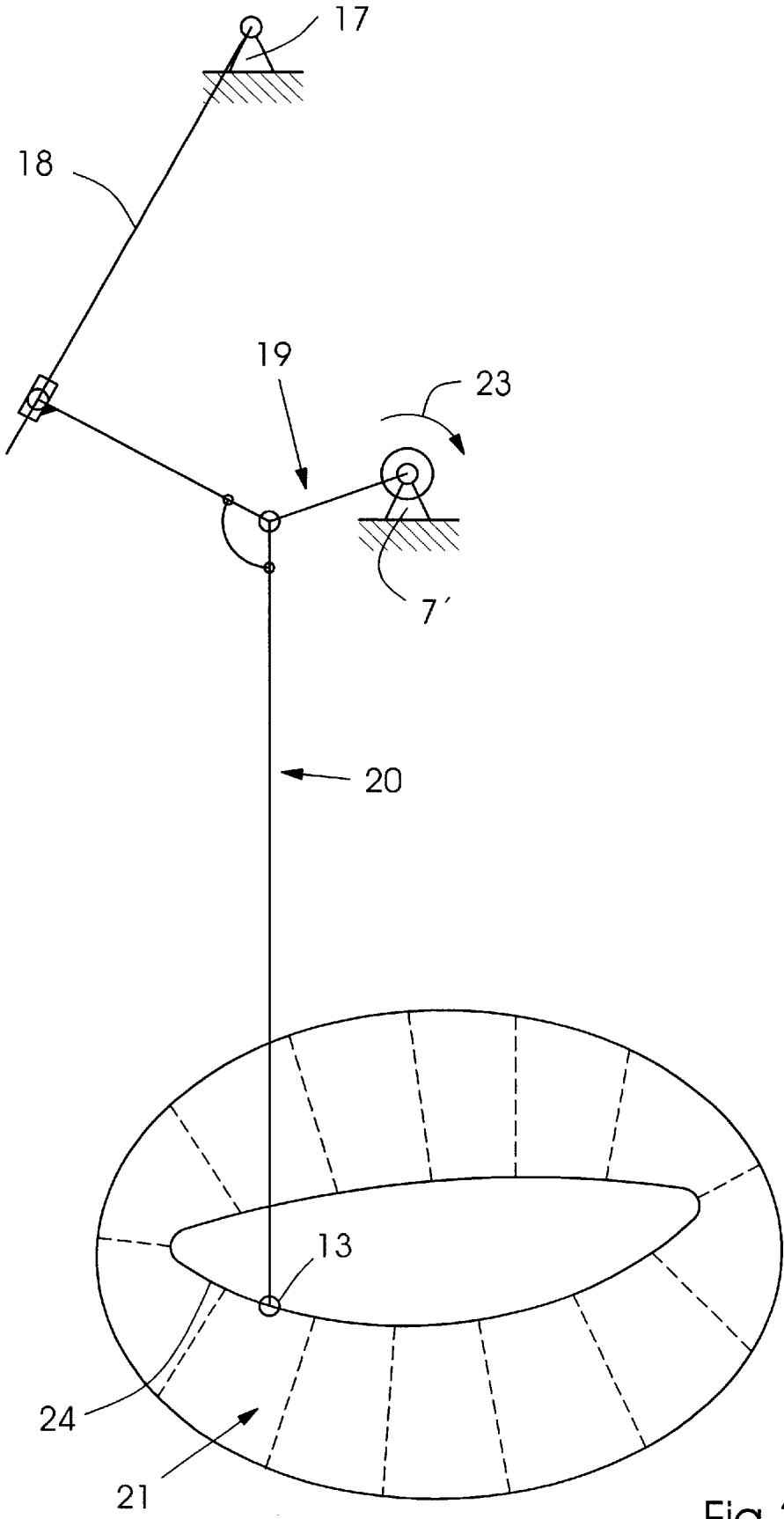
FIGS. 3*a* and 3*b* are illustrations of a coupler mechanism with a crank and a crank slider for producing an operating stroke with a catch-up character.
Figure 3B:
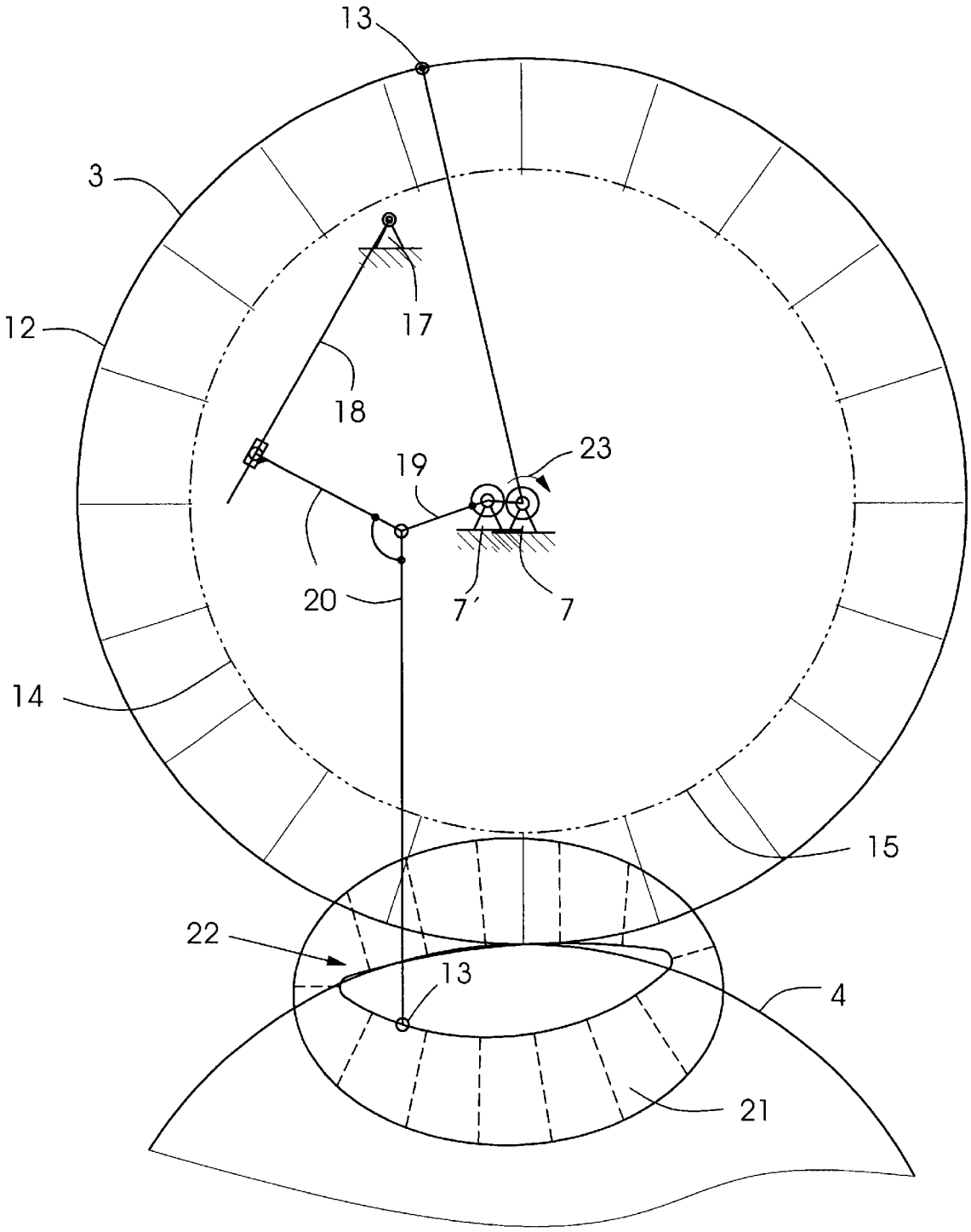

The illustrations according to FIGS. 3*a*, 3*b* reveals in more detail a coupler mechanism (sliding crank) for producing a operating stroke with a catch-up character.

The transfer cylinder 3, accommodated in the fixed bearings 7, 7' in both walls of the printing unit of the rotary printing machine, for example, has the speed variation 15 which is characterized by the fact that the outer surface 12 of the transfer cylinder 3 revolves at a constant speed. The direction of rotation of the transfer cylinder 3 is designated by reference symbol 23 on the fixed bearing 7. Mounted at a pivot 17 disposed offset from the fixed bearing 7 is a double sliding crank 18, which is connected to a rigid coupling element 20. An operating movement 22 of the coupler 20 is achieved by its attachment, by the double sliding crank 18, at the offset pivot 17, while the drive to the coupler element 20, of angled configuration, is provided via a crank 19 which, in turn, is rotatably accommodated on the fixed bearing 7'. Reference symbol 21 in FIGS. 3*a*, 3*b* represents the speed variation which is established, and reference symbol 24 represents the respective position of the operating element 13. From the speed variation 21, it emerges that the operating element 13 runs through areas with speeds which are high as compared with the train of curves 15 while, as compared with this, substantially shorter speed sections are established in which the speed of the operating element 13 is low relative to the speed variation 15 of the outer surface 12 of the transfer cylinder 3. According to the speed variation, which is designated by reference symbol 21, an operating stroke of the operating element 13 with a catch-up character is established.

Figure 4:
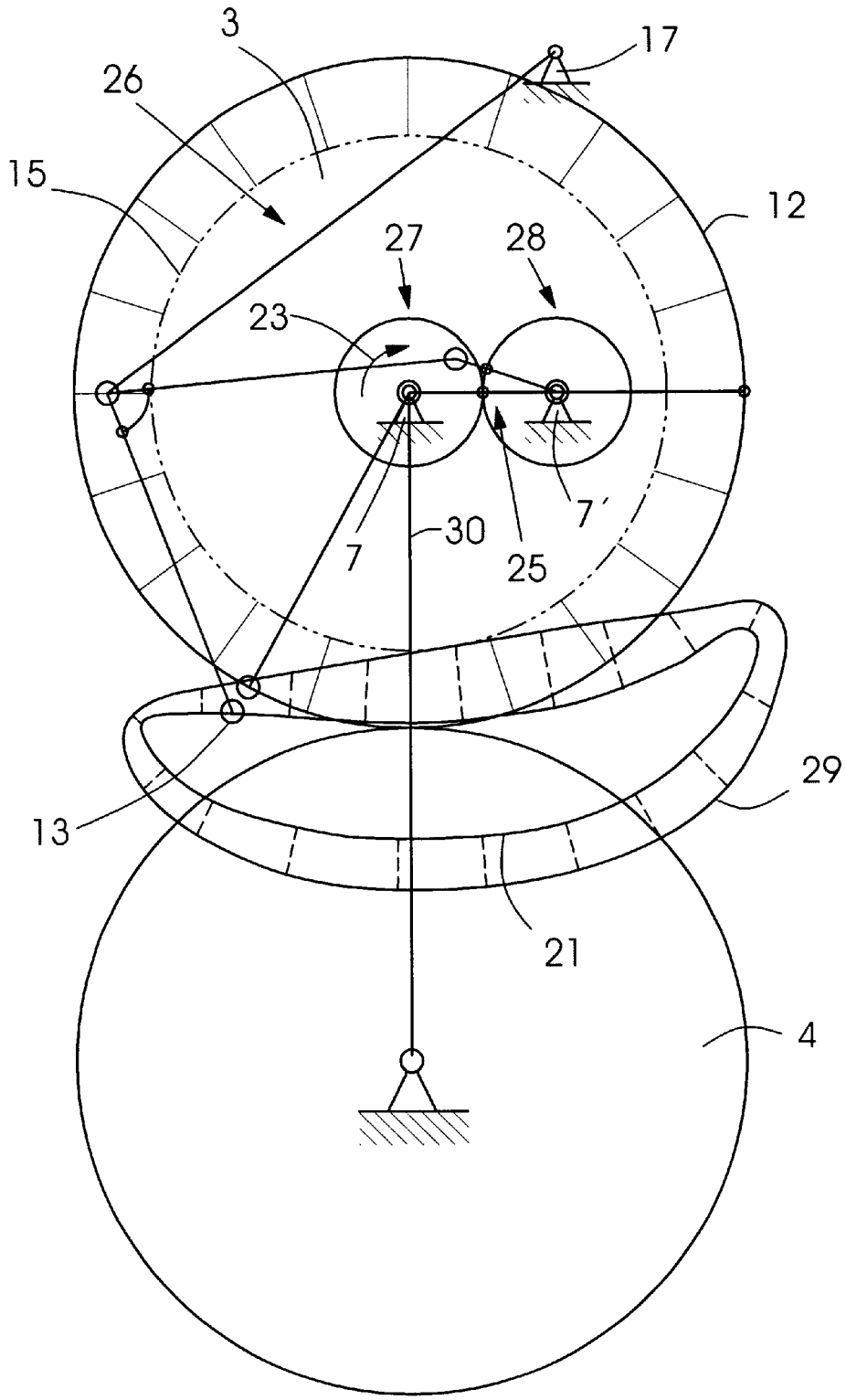
FIG. 4 is an illustration of the coupler mechanism with a pivot offset from a cylinder center for transmission elements.

The illustration according to FIG. 4 reveals in more detail a coupler mechanism having a pivot offset from the cylinder center.

According to the configuration, too, the outer surfaces 12 of the two mutually cooperating cylinders 3 and 4 of the printing unit of the rotary printing machine form the press nip 2. The transfer cylinder 3 is rotatably accommodated in the fixed bearing 7; accommodated coaxially with the cylinder axis of the transfer cylinder 3 is a drive pinion 27, which meshes with an output pinion 28. The drive pinion 27 is rigidly connected to the transfer cylinder 3 and rotates in the direction of rotation designated by reference symbol 23. A point on the outer surface of the transfer cylinder 3 has a speed variation that is designated by reference symbol 15. Disposed offset from the pivot 17 is a rocker 26, which drives a coupler on which the operating element 13 is located. The speed variation established on the operating element 13 is revealed in more detail by the train of curves 29. The train of curves 29 contains regions in which the operating element 13 assumes a relatively high speed, and also regions in which the speed of the operating element 13 is relatively low in relation to the circumferential speed of the transfer cylinder 3. It is therefore also possible here to produce an output movement of the synchronization mechanism that is typical of a catch-up movement shortly before the critical point for avoiding a collision is reached.

Figure 5:
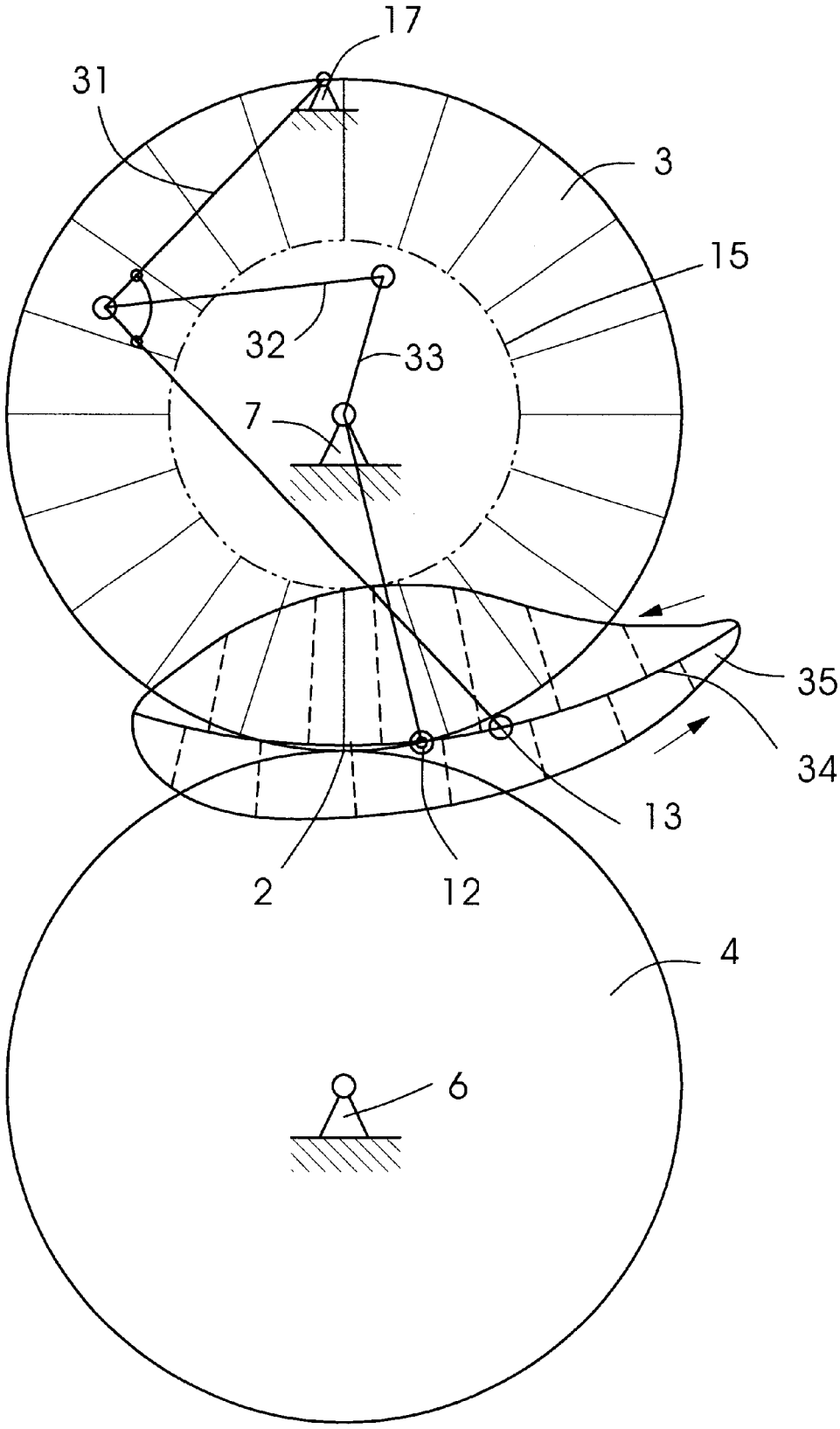
FIG. 5 is an illustration of the coupler mechanism with mutually opposed movements of the cylinder and the crank.

The schematic illustration according to FIG. 5 reveals a coupler mechanism (crank rocker) whose crank 33 is rigidly connected to the transfer cylinder 3 that is rotatably mounted in the fixed bearing 7.

The coupler 32 connects the crank 33 to the rocker 31, which is rotatably mounted in the fixed bearing 17 disposed offset from the fixed bearing 7 of the transfer cylinder 3.

The operating point 13 is rigidly connected to the rocker 31. As a result, a movement path 34 of the operating point 13 is a circular arc, which is passed through in an oscillatory manner. A speed hodograph 35 of the operating point 13 shows the non-constant variation of the speed during the back and forth movement.

At the synchronization point in the area of the press nip 2, the operating point 13 has the same speed as the point 12 on the outer surface of the transfer cylinder 3. Before the synchronization point, the operating point 13 has a lower speed than the point 12 on the outer surface of the transfer cylinder, so that as a result a catch-up movement for avoiding collisions is possible.

Figure 6:
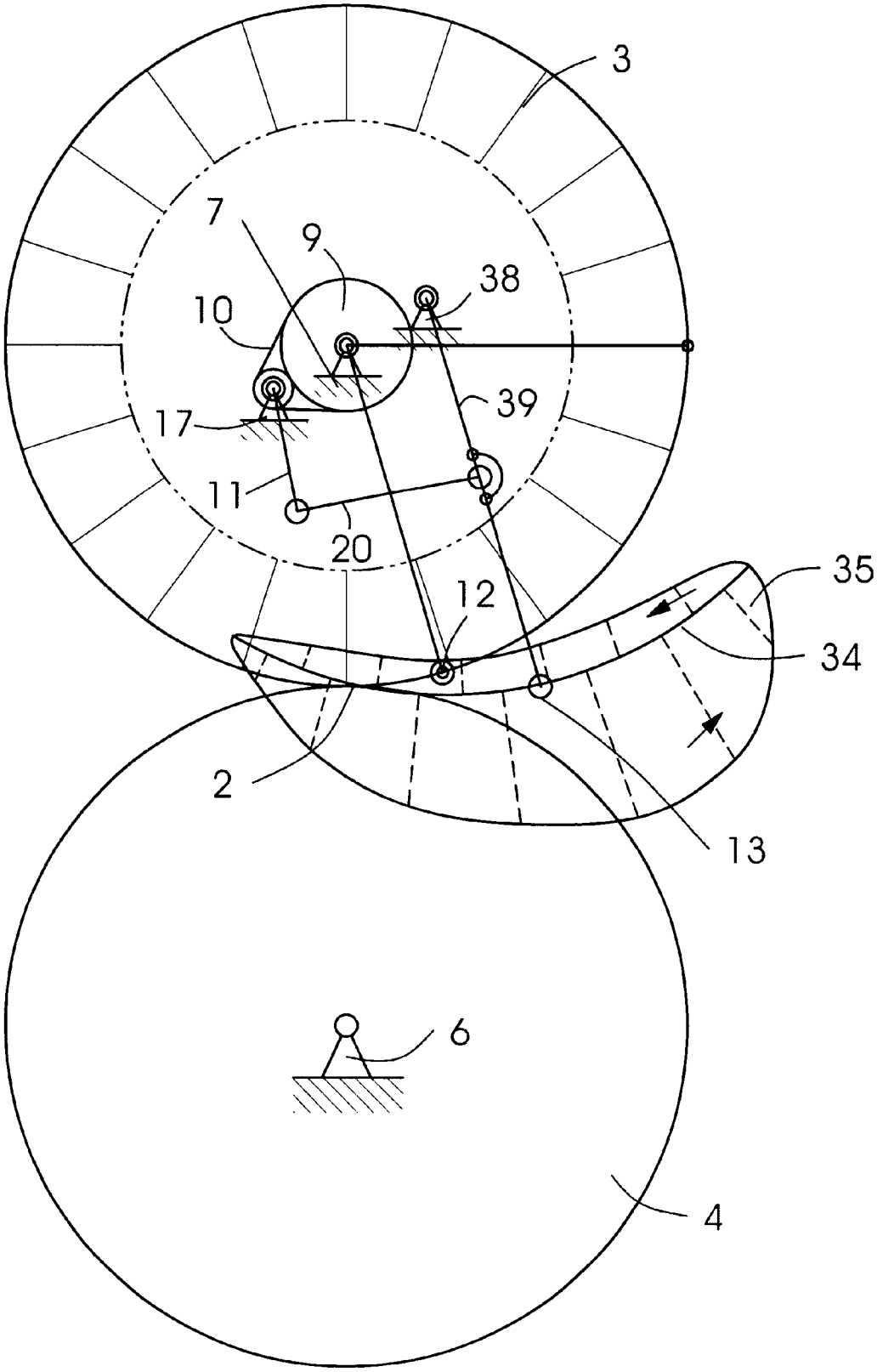
FIGS. 6 and 6*a* are illustrations of the coupler mechanism with a transmission ratio different from 1.
Figure 6A:
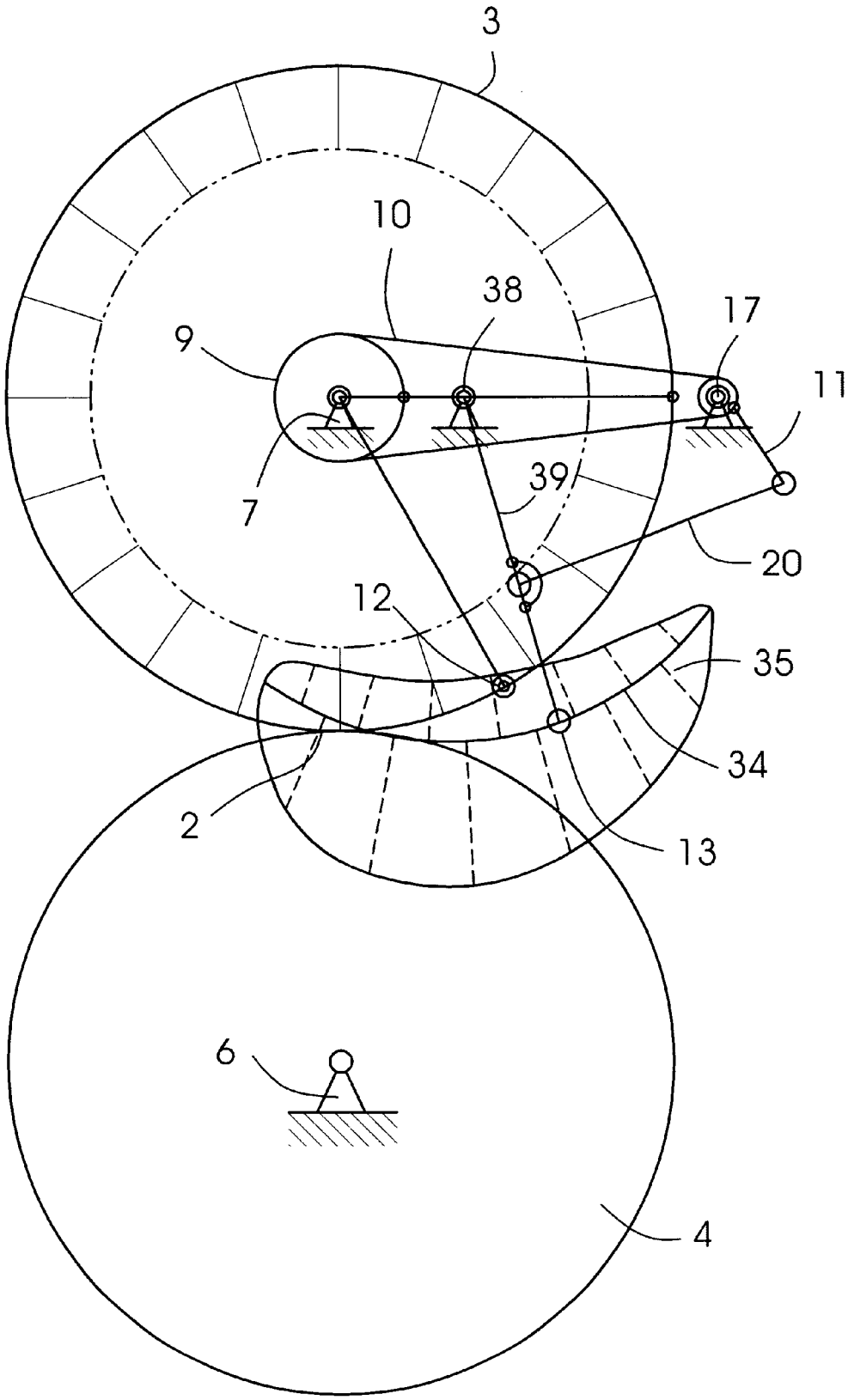

The schematic illustrations according to FIGS. 6 and 6*a* each reveal a coupler mechanism (crank rocker) that is driven by the transfer cylinder 3 with a transmission ratio different from 1.

The transfer cylinder 3 rotates about the fixed bearing 7, the impression cylinder 4 about the fixed bearing 6.

Permanently connected to the transfer cylinder 3 is the belt pulley 9 that, together with the flexible drive 10, drives a second belt pulley, which is rigidly connected to the crank 11.

The crank 11 is rotatably mounted in the fixed bearing 17, which is offset with respect to the fixed bearing 7 of the transfer cylinder 3.

The revolving attachment point of the crank 11 drives the coupler 20, which in turn is connected in an articulated manner to a rocker 39. The rocker 39 is mounted in a rocker bearing 38 in the machine frame.

The operating point 13 is rigidly connected to the rocker 39. As a result, the movement path 34 of the operating point 13 is a circular arc, which is passed through in an oscillatory manner. The speed hodograph 35 of the operating point 13 shows the non-constant variation of the speed during the back and forth movement.

At the synchronization point in the area of the press nip 2, the operating point 13 has the same speed as a point on the outer surface 12 of the transfer cylinder 3. Before the synchronization point, the operating point 13 has a lower speed than the point on the outer surface 12 of the transfer cylinder 3, so that as a result a catch-up movement for avoiding collisions is possible.

Figure 7B:
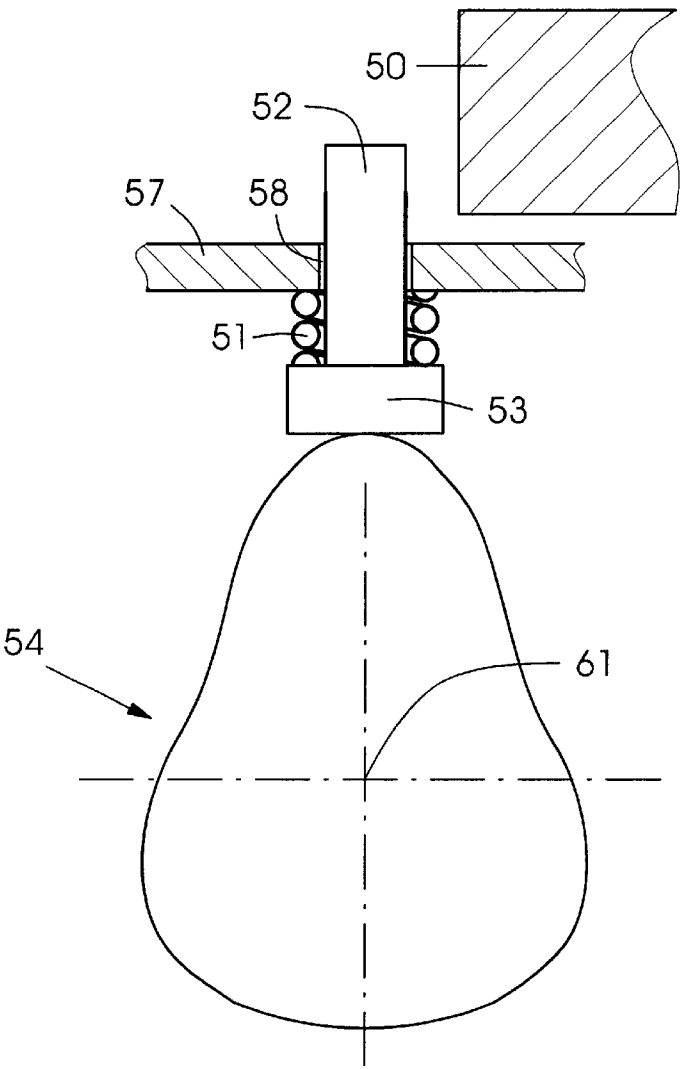
FIGS. 7*a* and 7*b* are diagrammatic, side-elevational views of a cam-controlled catching device for a carriage of a linearly driven gripper bar that can be moved in linear guides.
Figure 7A:
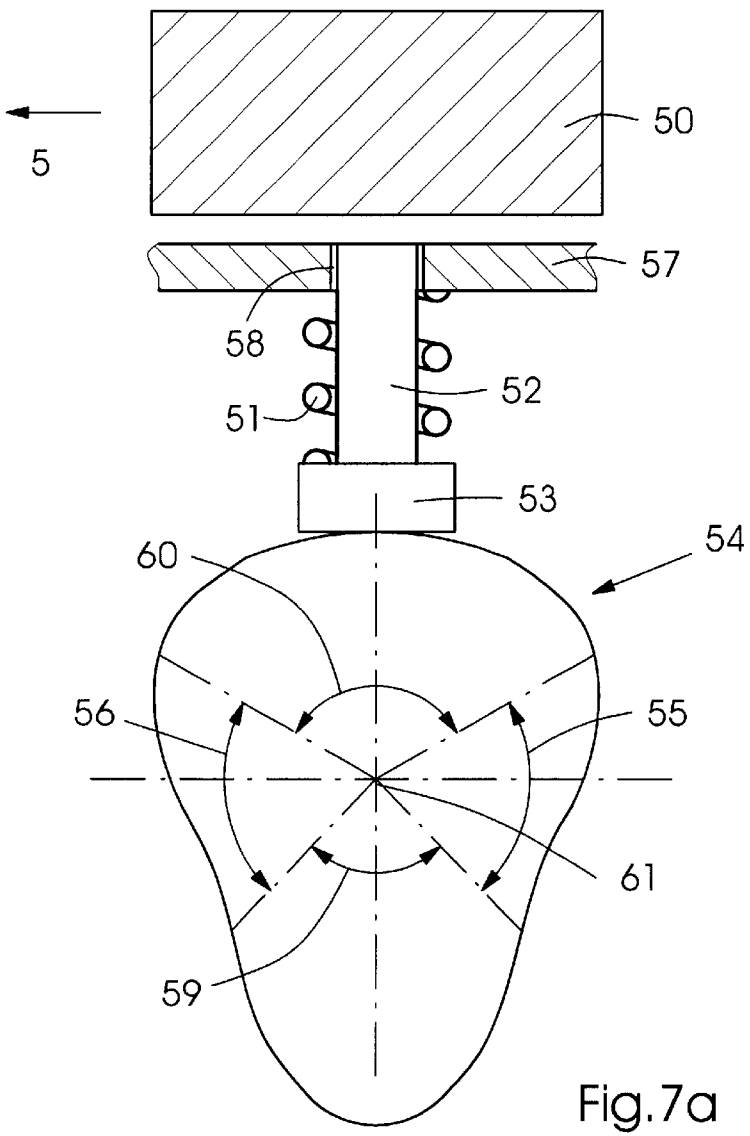

FIGS. 7*a*, 7*b* reveal in more detail a cam-controlled catching device for a carriage 50 that is part of a sheet conveyor drive system decoupled from the cylinder drive.

The carriage 50, on which a gripper bar 73 is mounted (see FIG. 10) moves substantially in the conveying direction 5 of the sheet material through the printing units of the rotary printing machine. The carriage 50 is substantially guided in linear guides 70 (FIG. 10) on frame walls 57 of the printing units of the rotary printing machine, be it one printing unit or a plurality of printing units connected one after another. The frame walls 57 are penetrated by individual openings into which, in turn, bolts 52 that can be pre-stressed by a spring element 51 can be let. The bolts 52 can be provided with a specifically fabricated hardened head area 53.

The bolts 52 are mounted such that they can be pre-stressed by the compression spring 51 and are operated on by a cam disk 54. The cam disk 54 may be subdivided substantially into two mutually opposite sections 60 and 59, of which one describes an upper latching curve 59, while reference symbol 60 designates the opposite, a lower latching curve. The two cam sections 59, 60 are in each case connected to each other on the cam disk 54 via transition regions 55 and 56, in order to ensure uniform contact with the bolt head 53 during the movement of the cam disk 54 about its axis 61. In the state shown in FIG. 7*a*, the securing bolt 52, which can be extended into an opening 58 of the frame wall 57, is deactivated, that is to say the carriage 50 belonging to a linear conveying unit or carriage 50 with the gripper bar 73 accommodated thereon can pass.

In contrast, in the illustration according to FIG. 7*b*, the cam disk 54 has moved about its axis of rotation 61 such that the area with a greater radius 59 bears on the head area 53 of the bolt 52 and forces the latter through the opening 58 in the frame side wall 57. As a result, the passage of the carriage 50 of the transport system conveying the sheet material in the movement direction 5 is stopped. The carriage 50 belonging to the gripper bar 73 and guided in the linear guide 70 is retarded because of a fault that has occurred or a malfunction. The carriage 50 is prevented from colliding with a cylinder as long as the securing bolt 52, activated by the cam disk 54, remains in the position shown in FIG. 7*b*.

Figure 8B:
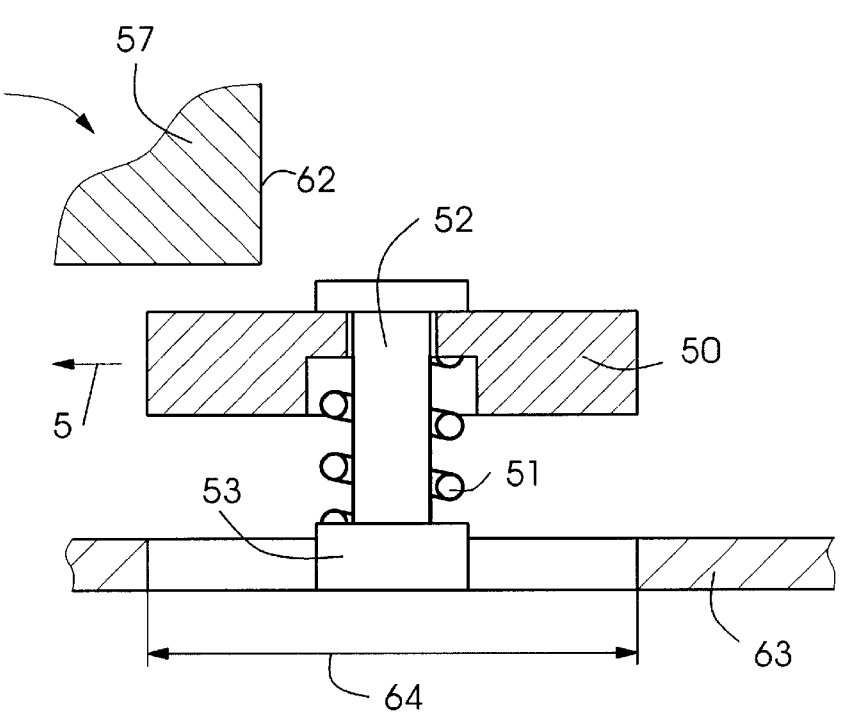
FIGS. 8*a* and 8*b* are side-elevational views of a form-fitting flexible drive, circulating with the cylinders, for the collision-free movement of the carriages through the press nip.
Figure 8A:
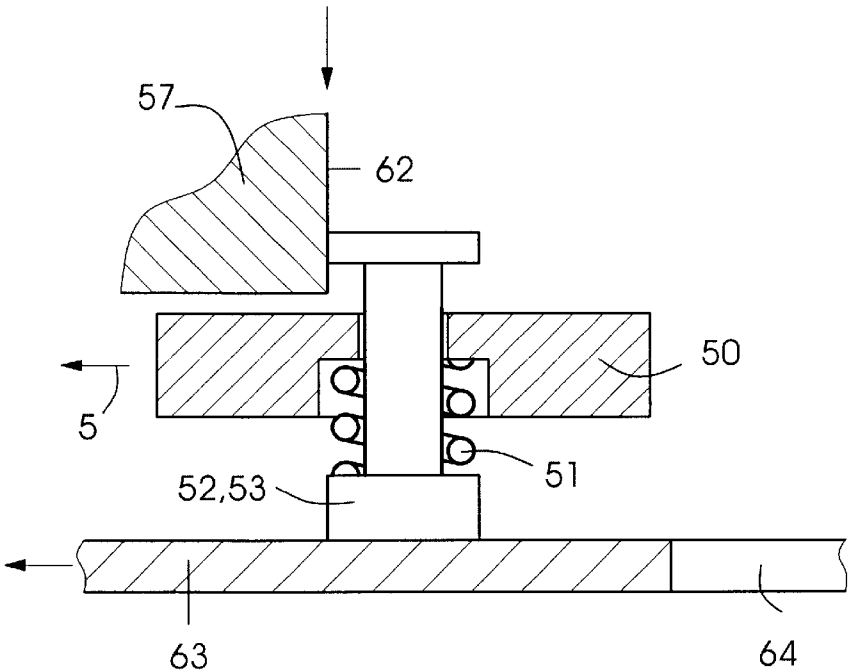

The illustrations according to FIGS. 8*a* and 8*b* reveal in more detail a form-fitting flexible drive circulating with the cylinders in the print unit for the collision-free movement of the carriages 50 through the press nip 2.

The illustrations according to FIGS. 8*a* and 8*b* show the carriage 50 driven by a linear drive 71 for conveying the sheet material through the printing unit. Besides the carriage 50 there is a circulating flexible drive 63 that, for example can be of a belt-like form (see FIG. 10).

Let into the circulating flexible drive 63 are mutually spaced, individual, slot-like openings 64. The slot-like openings 64 constitute those areas in which the carriages 50 belonging to the linearly driven gripper bars 73 can be positioned. Accordingly, a length of the slot 64 represents the time window in which a linear unit represented by the carriage 50 is able to pass the printing unit and the transfer cylinder 3 and the impression cylinder 4 cooperating with each other there.

Each of the carriages 50 is associated with the bolt securing element 52, which has the thickened head area 53 and is supported on the carriage 50 and pre-stressed by the spiral spring 51. The bolt securing element 52 that, according to FIG. 8*a*, has not dipped into a corresponding slot 64, strikes with a side facing away from the flexible drive 63 against a catching edge 62 formed on the frame wall 57.

In contrast, the carriage element 50 of the linear unit illustrated in FIG. 8*b* passes by the catching edge 62 of the frame wall 57, since the head 53 of the securing element 52 has dipped into the corresponding slot 64 in the flexible drive 63, this action effected by the force of the compression spring 51, so that the corresponding linear unit with the sheet material accommodated on it can pass through the subsequent printing unit, since freedom from collision is provided.

Figure 9:
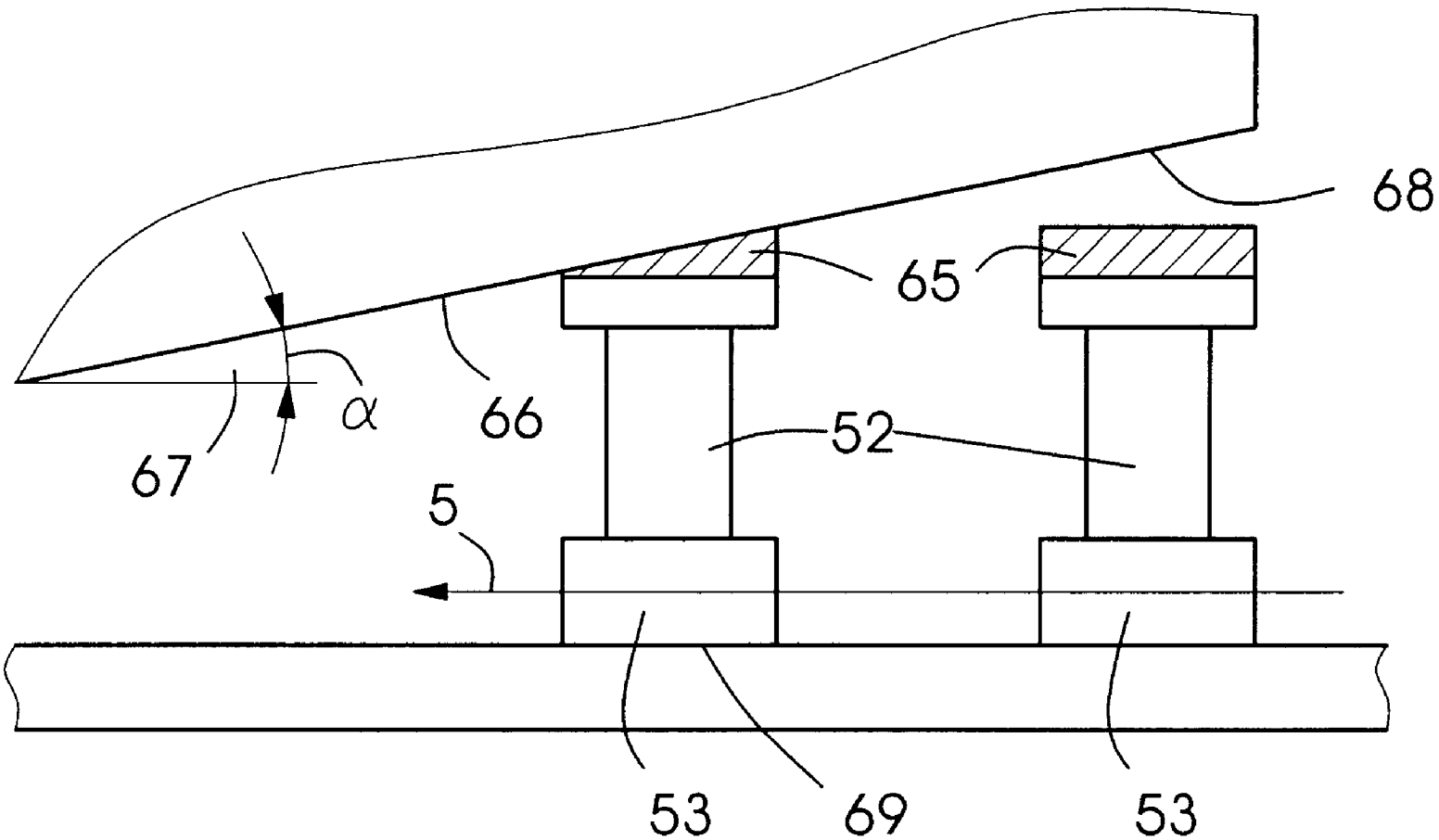
FIG. 9 is a side-elevational view of a variant for bringing about the braking of the carriages of the linearly driven gripper bars.

FIG. 9 shows a variant to bring about the braking of the carriages 50 of the linearly driven gripper bar 73.

In order to prevent an impact or impulse on the linear units that convey the carriage 50 through the printing units of the rotary printing machine, use can be made of a brake corresponding to the illustration of FIG. 9. For this purpose, a chamfer 66 fixed to the frame wall 57 is provided above the flexible drive 63. The angle of inclination of the chamfer is designated by 67, corresponding to the angle $\alpha$. In order to achieve a gradually increasing braking action, the bolts 52 functioning as securing elements 52 are provided with a coating 65 on the side opposite of the head area 53. The coating 65 functioning as a brake lining on the securing element 52 brings about a gradually increasing braking action during the passage under the chamfer 66. Between the chamfer 66 and the brake lining 65 of the respective bolt securing element 52 there is established the maximum possible frictional coefficient $\mu$, while, at the point designated by item number 69, the aim is that a frictional coefficient that is different from the frictional coefficient of the chamfer 66, that is to say a lower frictional coefficient, is established there. In addition to the frame wall 57 configured here as a braking chamfer, abrupt braking can also be prevented by a braking action being brought about by a gap which tapers slowly but continuously between the securing bolts 52 accommodated on the carriage 50 and catching disks disposed opposite the bolt.

Figure 10A:
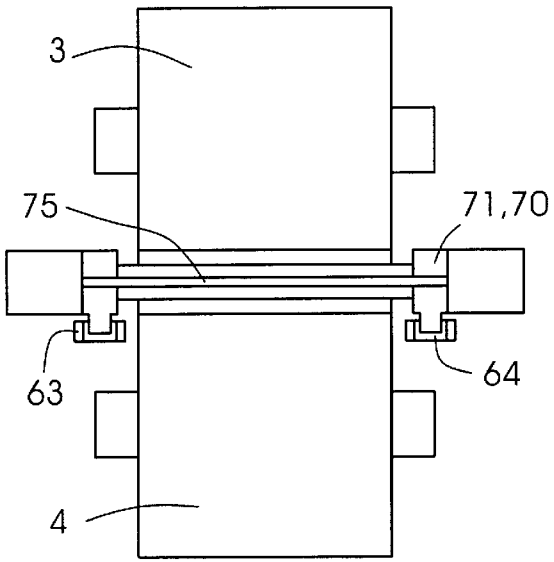
FIG. 10*a* is a front-elevational view of the form-fitting flexible drive circulating at the same tangential speed as the cylinders.
Figure 10:
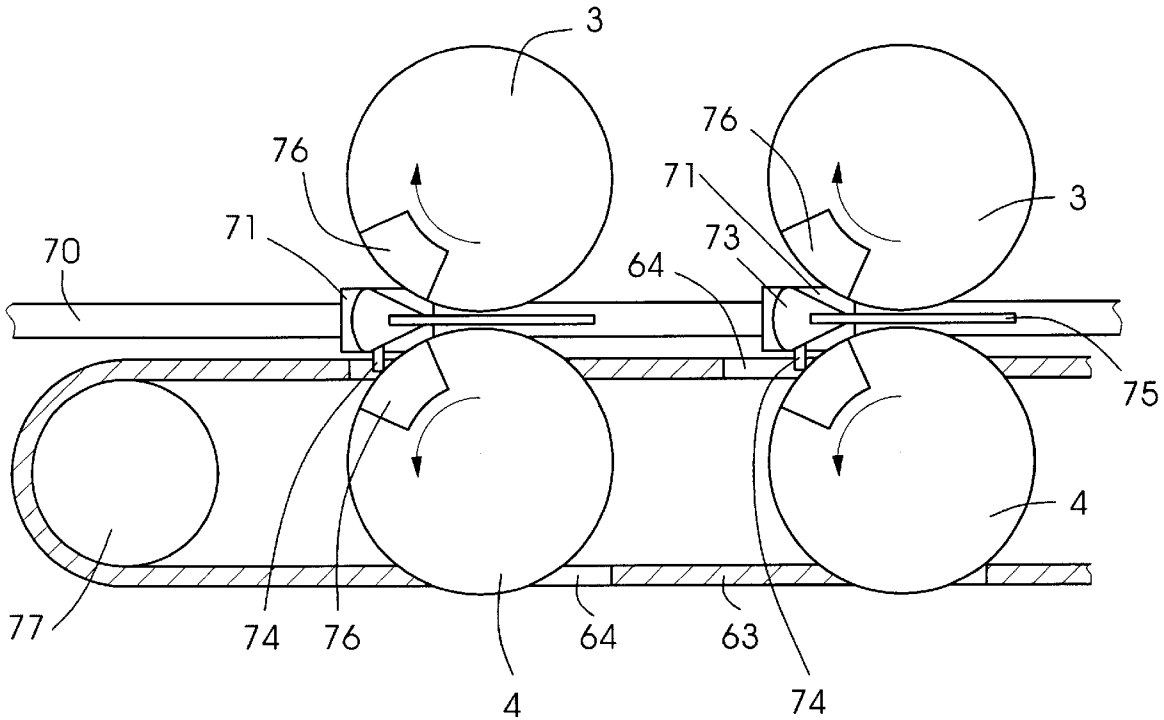
FIG. 10 is a diagrammatic, side-elevational view of a form-fitting flexible drive circulating at the same tangential speed as the cylinders.

The illustration according to FIGS. 10 and 10*a* reveals in more detail the side view of the flexible drive 63 circulating with a form fit with the cylinders 3, 4 at the same tangential speed.

The belt-like flexible drive 63 runs around deflection elements 77, which, either as rolls or rollers, can be disposed underneath the conveying path of the sheet material 75. As already illustrated in FIGS. 8*a* and 8*b*, the flexible drive 63 is provided with slots 64, into which catching hooks 74 of the carriages 50 belonging to the gripper bars 73 which are driven by the linear drives 71 can dip. In each case, the leading edge of the sheet material 75 is fixed to the gripper bar 73 and is conveyed through the press nip 2 resulting between the transfer cylinder 3 and the blanket cylinder 4, in order to be printed on the upper side by the cover accommodated on the transfer cylinder 3. The two mutually cooperating cylinders, that is to say the transfer cylinder 3 and the impression cylinder 4, each have channel sections 76 on their circumference, in which, given exact synchronous guidance of the gripper bars 73, their upper sides dip, so that collision-free passage of the gripper bars 73 driven by the linear drives 71 through the press nip 2 defined between the outer surfaces of the two mutually cooperating cylinders can take place. The gripper bars 73 are conveyed in the linear guides 70, reproduced schematically here in the form of rails, parallel to the flexible drive 63 circulating synchronously and with a form fit with the cylinders and assuming the tangential speed of the latter.

The illustration according to FIG. 10*a* reveals a front view—reproduced here in a very simplified schematic manner—of the linear units and also of the sheet material 75 gripped by the gripper bars 73. The linear guides 70 extend on both sides, opposite one another, on the ends of the mutually cooperating cylinders 3 and 4. In the illustration according to FIG. 10*a*, the catching hooks 74 of the gripper bars 73 are dipping into the slots 64 of the belt-like flexible drive 63. Instead of a circulating closed belt, its configuration can also be imagined as a chain.

Figure 11:
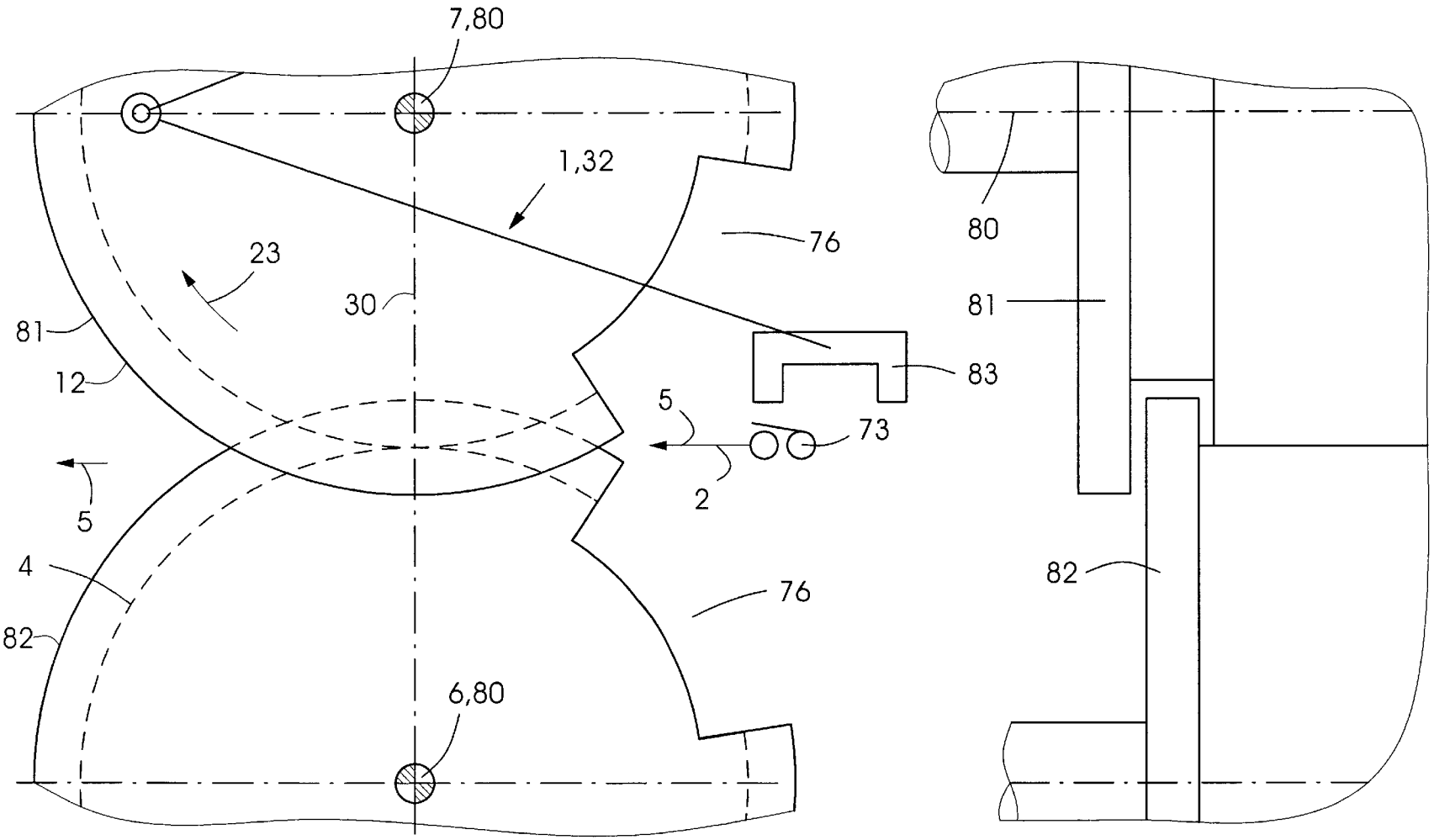
FIG. 11 is an illustration of catching disks associated with the cylinders to enable the conveying movement of the carriages of the linearly driven gripper bars.

The illustration according to FIG. 11 reveals that the mutually cooperating cylinders 3 and 4 of the printing unit of the rotary printing machine are assigned catching disks 81 and 82 at the ends, coaxially with a cylinder axes 80. The catching disks 81 and 82 are provided with recesses on their circumference in the area of the channels of the transfer cylinder 3 and of the impression cylinder 4. The recesses in the catching disks 81 and 82 align with the cylinder channels 76 in the mutually cooperating cylinders of the printing unit. In the cylinder channels 76 of the cylinders 3, 4 on the sheet-processing rotary printing machines, the clamping devices for the covers, be they rubber blankets or films, such as anti-smear films, are fastened by their ends and tensioned and, during operation, are kept under continuous, preferably uniform circumferential tension. The reference symbols 1 and 32 designate a coupler synchronization mechanism that is mounted at the remote pivot 17 and which accommodates a catching clamp 83 at the extended end of the coupler 32. The opening in the catching clamp 83 is preferably prepared in such a way that, in the event of an apparent collision between the gripper bar 73 and the circumferential surface of one of the cylinders 3 or 4, it engages around the gripper bar 73 and releases it again only when the gripper bar 73 passes through the press nip 2 between the mutually cooperating cylinders 3, 4 without damaging them. The angled coupler 32 reproduced schematically in FIG. 11 is preferably part of the coupler mechanism illustrated in FIG. 5, attached in an articulated manner to the rocker 31 and the crank 33 rotating around the fixed bearing 7.

Figure 12:
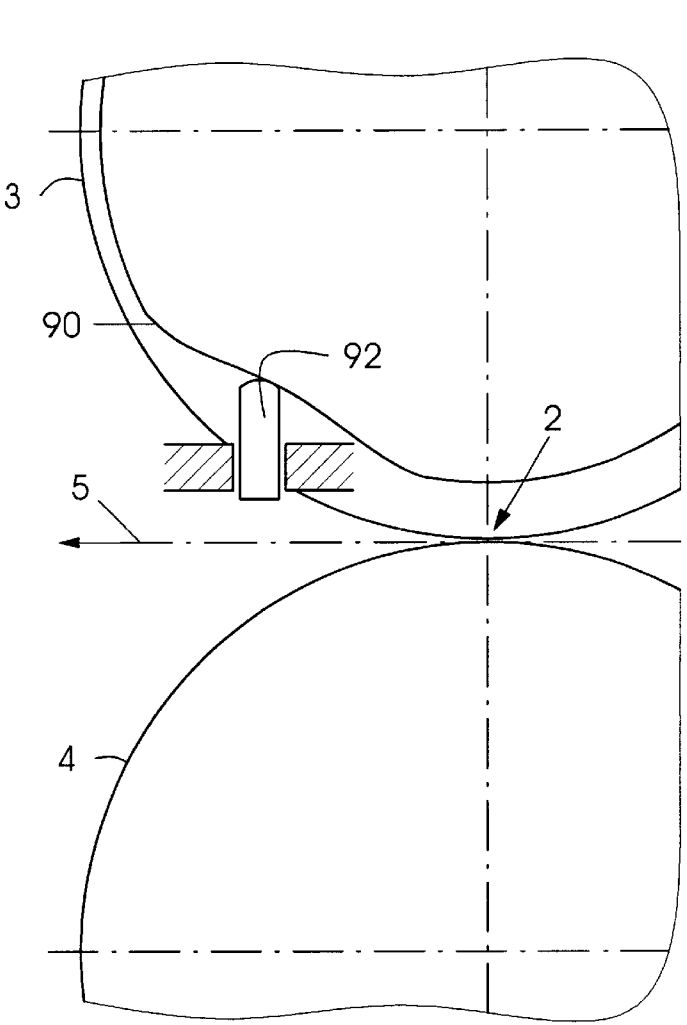
FIG. 12 is an illustration of the catching devices, which can be operated by the cylinders or directly via the rotation of the cylinder, for the carriages of the linear drives.
Figure 12:
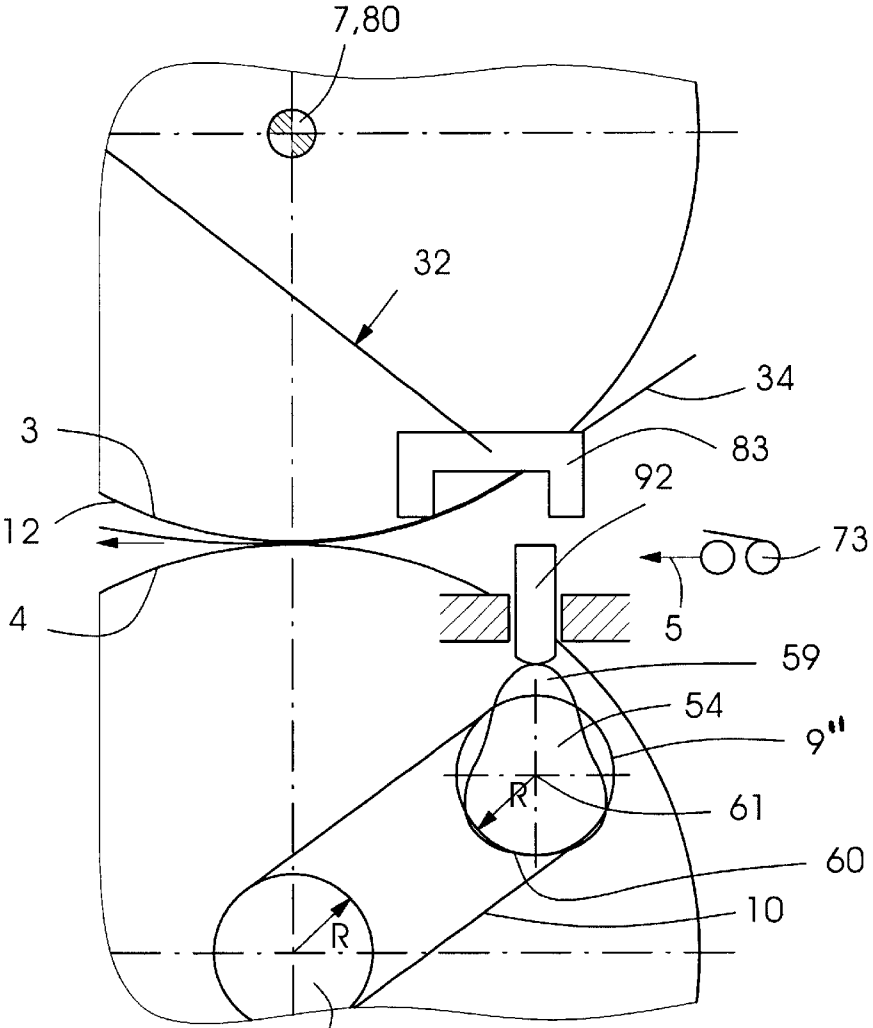

The illustration according to FIG. 12 reveals in more detail the catching device 83, which can be operated indirectly by the cylinder and directly via the rotation of a cylinder, for the gripper bars 73 driven by the linear drives 71 in the printing unit of rotary printing machines.

In a way analogous to the configuration variants already described, the cylinders 3, 4 rotate about the cylinder axis 80, which in each case are accommodated fixed to the frame in fixed bearings 6 and 7 in the side walls of the rotary printing machine. Associated with the impression cylinder 4 is the belt pulley 9, which is connected to the belt pulley 9" driving the cam disk 54 by the flexible drive 10, be it a belt drive or a toothed-belt drive. The belt pulleys 9, 9", of which one is accommodated coaxially with the cylinder axis 80 of the impression cylinder 4 and the other is accommodated coaxially with the axis 61 of the cam disk 54, preferably have the same diameter. The cam disk 54, whose circumferential contour brings about the vertical movement of an extendable stop finger 92, has an area with the upper radius area 59, and the lower radius area 60 positioned opposite, analogous to the illustration of the cam disk according to FIGS. 7*a* and 7*b*. Disposed above the sheet conveying plane 5 is the catching clamp 83, which, however, via the angled coupler element 32, see the illustration according to FIG. 11 and 5, is connected to the coupler mechanism 32 on the transfer cylinder 3. The catching clamp 83 according to FIGS. 11 and 12 represents, for example, the operating element 13, which travels the path 34 according to the illustration of FIG. 5.

In addition, the illustration according to FIG. 12 reveals that the mutually cooperating cylinders 3 and 4 can each be assigned cam segments 90. These can be accommodated coaxially with the axes of rotation 80 of the two mutually cooperating cylinders 3 and 4, their cam contour acting directly on a rounded surface of a stop finger 92. The latter moves out of its mounting during appropriate passage of a cam section segment configured to be elevated and prevents a gripper bar, driven by the linear units 71, moving into the press nip 2 of the corresponding printing unit.

The apparatus proposed in accordance with the invention for preventing collisions in sheet transport systems whose drive is decoupled from the drive of the mutually cooperating cylinders may be used on all such sheet-processing machines and their components that are equipped with individual drive technology. Furthermore, a range of uses is opened in all conveying devices based on linear drives in which collision protection is necessary, because there are mechanically inter-engaging elements which are moved by different drives. In the case of rotary printing machines, register accuracy is ensured by an electronic route, while the decoupling of the drive of the transport systems from the rotational drive of the cylinder involve safe guarding the latter against possible collision in the event of a fault. By using the solution proposed in accordance with the invention, the collision-free entry of the gripper bars 73 into the printing area 2 in the case of advanced or retarded gripper bars 73 can be ensured. In normal operation, that is to say during the normal continuous printing state, there is no contact between the synchronization mechanisms 1, 20, 32 and the gripper bars 73. Likewise, in the case of non-synchronous, that is to say in the case of retarded or advanced gripper bars 73, it is possible to achieve acceleration or retardation of the latter, by which account can be taken of changing conveying conditions in the event of a fault. An aspect not to be dismissed as small is that all the elements of the synchronization units are connected mechanically to the cylinders to be protected, so that no undefined states can occur.

We claim:

1. An apparatus for transporting a sheet material in a sheet-processing machine having individual stations with cylinders, comprising:

a transport system for the sheet material having drives driven independently of the cylinders of the individual stations processing the sheet material in the sheet-processing machine; and at least one cylinder-coupled collision safeguard functioning as a synchronization mechanization bringing about a synchronization of said transport system conveying the sheet material and the cylinders.

2. The apparatus according to claim 1, wherein the cylinders include a transfer cylinder and a carrying cylinder carrying the sheet material, said synchronization mechanism functioning as a collision safeguard having an output drive movement coupled to a position of at least one of the transfer cylinder and the carrying cylinder.

3. The apparatus according to claim 2, wherein said transport system has a linear element conveying the sheet material and said synchronization mechanism functioning as the collision safeguard has an output element driven at a higher speed than a tangential speed of said linear element.

4. The apparatus according to claim 2, wherein said transport system includes a carriage, a gripper bar disposed on said carriage, and linear guides in which said carriage is guided, said synchronization mechanism includes a securing element and a cam disk controlling a position of said securing element, said securing element enables or prevents a passage of said carriage with said gripper bar along said linear guides.

5. The apparatus according to claim 4, wherein said cam disk has mutually different radial areas effecting an extension/retraction movement of said securing element in one of said linear guides guiding said carriage.

6. The apparatus according to claim 1, including:

an operating element disposed on one of the cylinders;

a flexible drive mechanism having a circulating flexible drive which overtakes said operating element at a speed which catches up with the cylinders set in rotation, said synchronization mechanism driving said flexible drive mechanism.

7. The apparatus according to claim 1, including a pivot offset relative to an axis of rotation of one of the cylinders, and said synchronization mechanism has transmission elements of which one is rotatably accommodated on said pivot.

8. The apparatus according to claim 7, including a crank rotating about said pivot, and one of said transmission elements is a rigid coupler coupled to said crank.

9. The apparatus as claimed in claim 7, including:

an operating element;

a coupling device selected from the group consisting of an angled coupler and coupling gear wheels; and a rocker accommodated on said pivot and engaging said coupling device to impart to said operating element a speed variation with a catch-up character in relation to a rotational speed of one of the cylinders.

10. The apparatus according to claim 1, including a flexible drive mechanism circulating at a tangential speed of the cylinders and associated with said synchronization mechanism.

11. The apparatus according to claim 10, wherein said transport system includes linearly driven units having carriages with securing elements for conveying the sheet material, said flexible drive mechanism has openings formed therein functioning as dip-in areas for engaging said securing elements of said carriages of said linearly driven units.

12. The apparatus according to claim 10, wherein said flexible drive mechanism circulates synchronously and with a form fit with the cylinders.

13. The apparatus according to claim 10, wherein said transport system includes linearly driven units having carriages, gripper bars accommodated on said carriages for conveying the sheet material, and bolt-shaped securing elements each with a stop surface disposed on said carriages, when said stop surface runs onto one of a braking chamfer and a continuously tapering gap formed in a side wall of one of the individual stations processing the sheet material, gradual braking of a respective one of said gripper bars accommodated on one of said carriages occurs.

14. The apparatus according to claim 10, including:

a stop finger disposed on one of the cylinders; and a cam disk for controlling a positioning of said stop finger and said cam disk is driven by a drive of one of the cylinders.

15. The apparatus according to claim 14, wherein the cylinders are formed with cam segments which can extend said stop finger directly into a conveying path of the sheet material.

16. The apparatus according to claim 1, wherein the cylinders have channels formed therein and ends, and including catching disks disposed at the ends of the cylinders, said catching disks function as stops and have recesses formed therein aligned with the channels in the cylinders.

17. A rotary printing machine, comprising:

a sheet-processing machine having individual stations with cylinders for processing a sheet material;

an apparatus for transporting the sheet material in said sheet-processing machine, said apparatus having a transport system for the sheet material with drives driven independently of said cylinders of said individual stations processing the sheet material in said sheet-processing machine; and at least one cylinder-coupled collision safeguard bringing about a synchronization of said transport system conveying the sheet material and said cylinders.

18. The rotary printing machine according to claim 17, including a turner device.

19. A multicolor rotary printing machine, comprising:

a sheet-processing machine having individual stations with cylinders for processing a sheet material;

an apparatus for transporting the sheet material having a transport system with drives driven independently of said cylinders on said individual stations processing the sheet material in said sheet-processing machine; and at least one cylinder-coupled collision safeguard bringing about a synchronization of said transport system conveying the sheet material and said cylinders.

20. The rotary printing machine according to claim 19, including a turner device.

* * * * *